US006190187B1

(12) United States Patent
Okabe et al.

(10) Patent No.: US 6,190,187 B1
(45) Date of Patent: Feb. 20, 2001

(54) CONNECTOR OF LEVER FIT TYPE

(75) Inventors: Toshiaki Okabe; Toshiaki Ozawa, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/390,277

(22) Filed: Sep. 3, 1999

(30) Foreign Application Priority Data

Sep. 10, 1998 (JP) ..... 10-257125

(51) Int. Cl.[7] ..... H01R 13/62
(52) U.S. Cl. ..... 439/157; 439/354
(58) Field of Search ..... 439/157, 341–345, 439/357, 358

(56) References Cited

U.S. PATENT DOCUMENTS

| | | | | |
|---|---|---|---|---|
| 5,487,678 | * | 1/1996 | Tsuji et al. | 439/352 |
| 5,788,527 | * | 8/1998 | Sanders et al. | 439/352 |
| 5,921,808 | * | 7/1999 | Haftmann et al. | 439/495 |
| 5,975,929 | * | 11/1999 | Matsuura et al. | 439/157 |

FOREIGN PATENT DOCUMENTS

| | | |
|---|---|---|
| 6-275337 | 9/1994 | (JP) . |
| 10-247551 | 9/1998 | (JP) . |

* cited by examiner

*Primary Examiner*—Brian Sircus
*Assistant Examiner*—Son V. Nguyen
(74) *Attorney, Agent, or Firm*—Sughrue, Mion, Zinn, Macpeak & Seas, PLLC

(57) ABSTRACT

The present connector is a lever fitting type connector 20 that, by rotating a lever (2), a male connector (1) can be inserted and fitted into a fitting hood portion (4) of a female connector portion (3), while a lock arm 11 disposed in the lever (2) can be engaged with a lock portion (21) formed in the fitting hood portion (4). The lock arm (11) is composed of a flexible arm portion (12) and a lock-arm-(11)-side securing projection (13) formed in the flexible arm portion (12), whereas the lock portion (21) is composed of a reduced thickness plate portion (22) formed in the inner wall **(4*a*) of the fitting hood portion (4) and a fitting-hood-portion-(4)-side securing projection (23) at least part of which is projected from the reduced thickness portion (22) and also which can be engaged with the lock-arm-11-side securing projection (13). Thanks to this structure, when the lock-arm-(11)-side securing projection (13) goes beyond the lock-portion-(21)-side securing projection (23), the reduced thickness plate portion (22) once flexes greatly and thereafter returns back to its original shape, with the result that an operation sound generated when the male connector (1) is locked into the fitting hood portion (4) of the female connector portion (3)** can be made louder, thereby being able to enhance the sense of moderation of the connector.

4 Claims, 5 Drawing Sheets

CONNECTOR OF LEVER FIT TYPE

BACKGROUND OF THE INVENTION

1. Field of the Invention

The present invention relates to a lever fitting type connector that, by rotating a lever assembled to a male connector, the male connector can be inserted into and fitted with a fitting hood portion formed in a female connector portion thereof.

2. Related Art

Now, FIG. 4 shows the main portions of a lever fitting type connector; and, in particular, a male connector 1, and a lever 2 which is rotatably assembled to the male connector 1. The male connector 1 can be inserted into and fitted with a fitting hood portion 4 formed in a female connector portion (see FIG. 5) 3 of the lever fitting type connector, by rotating the lever 2.

The male connector 1 includes a plurality of terminal storage chambers which respectively extend through the male connector 1 in the vertical direction thereof and store therein their associated terminals. Also, the male connector 1 includes two play preventive ribs 6 and 6 which are respectively provided on and projected laterally from the respective one-end portions of the two side surfaces 5 of the male connector, while the play preventive ribs 6 and 6 respectively extend in the fitting direction of the male connector 1. And, the male connector 1 further includes two boss portions 7 which are respectively provided on and projected from the two side surfaces 5, while the lever 2 is rotatably supported on the boss portions 7.

The lever 2 includes a pair of right and left side walls 8, 8, and an operation portion 9 which connects together the right and left side walls 8 and 8 on the rear end side thereof. The two boss portions 7 of the male connector 1 are respectively inserted into the right and left side walls 8 and 8: that is, the lever 2 can be rotated about the boss portions 7 thanks to the insertion of the boss portions 7 into the right and left side walls 8 and 8. Also, on the respective leading ends of the side walls 8 and 8 that are located on the opposite side to the operation portion 9, there are formed two projection portions 10 and 10 which are respectively united integrally with their associated side wall ends and extend through their associated play preventive ribs 6 of the male connector 1. These projection portions 10 and 10 are respectively inserted into their associated elongated holes which are so formed as to extend through a fitting hood portion (which will be discussed later) formed in a female connector portion of the present connector, so that they provide the fulcrum of rotation of the lever 2. Also, a lock arm 11 is disposed between the right and left side walls 8 and 8 of the lever 2 and on the operation portion 9 side. The lock arm 11 includes a flexible arm portion 12, and a lock arm 11 side securing projection 13 which is provided on the arm portion 12.

The female connector portion 3 includes a fitting hood portion 4 the upper surface of which is opened and into which the male connector 1 can be inserted. In the inner wall of the fitting hood portion 4 on the upper end side thereof, there is formed a lock portion 14 with which the lock arm 11 of the lever 2 can be engaged. The lock portion 14 is composed of a fitting hood portion 4 side securing projection 15 which is provided on and projected inwardly from the inner wall of the fitting hood portion 4. Also, in the fitting hood portion 4, there is formed an elongated groove (not shown) into which the play preventive rib 6 of the male connector 1 can be inserted; and, on the side surface of the fitting hood portion 4, there are formed two elongated holes (not shown) into which the projection portions 10 of the lever 2 can be respectively engaged.

In the present lever fitting type connector, the two boss portions 7 of the male connector 1 are respectively inserted into the right and left side walls 8 of the lever 2 and also the two projection portions 10 are respectively inserted through their associated play preventive ribs 6, so that the connector can be assembled in such a manner as shown in FIG. 4. And, after the male connector 1 with the lever 2 assembled thereto is inserted into the fitting hood portion 4 of the female connector portion 3 and the two projection portions 10 of the lever 2 are respectively engaged into their associated elongated holes of the fitting hood portion 4, the operation portion 9 is pressed to thereby rotate the lever 2 in a direction of an arrow line 16 shown in FIG. 5. Due to the leverage of the rotation of the lever 2, the male connector 1 can be inserted into and fitted with the fitting hood portion 4 of the female connector portion 3.

If the male connector 1 is inserted into and fitted with the fitting hood portion 4, then the lock arm 11 side securing projection 13 is engaged with the fitting hood portion 4 side securing projection 15. This can prevent the unexpected rotation of the lever 2 as well as can hold the fitted state of the male connector 1 with the female connector portion 3.

However, when the lock arm 11 side securing projection 13 is engaged with the fitting hood portion 4 side securing projection 15, as shown in FIG. 6, the lever 2 is rotated about the boss portions 7, so that these two securing projections 13 and 15 are engaged with each other in such a state as near to a line contact. Therefore, when the two securing projections 13 and 15 are engaged with each other, there can be generated only a low operation sound (locking sound), which lacks in the sense of moderation.

SUMMARY OF THE INVENTION

The present invention aims at eliminating the drawbacks found in the above-mentioned conventional lever fitting type connector. Accordingly, it is an object of the invention to provide a lever fitting type connector which can make louder an operation sound to be generated when a lever is locked, thereby being able to enhance the sense of moderation.

In attaining the above object, according to the present invention, there is provided a lever fitting type connector, comprising: a male connector; a lever to be rotatably assembled to the male connector; and, a female connector portion including a fitting hood portion into which, by rotating the lever, the male connector can be inserted, wherein, if a lock arm disposed on the lever is engaged with a lock portion formed in the fitting hood portion of the female connector portion, then the male connector can be completely fitted into the fitting hood portion of the female connector portion, characterized in that the lock arm is composed of a flexible arm portion and a lock arm side securing projection provided on the flexible arm portion, whereas the lock portion is composed of a reduced thickness plate portion formed in the inner wall of the fitting hood portion and a fitting hood portion side securing projection at least part of which is projected from the reduced thickness plate portion and also which can be engaged with the lock arm side securing projection.

According to the present lever fitting type connector, if the lever is rotated to thereby fit the male connector completely into the fitting hood portion of the female connector portion, then the lock arm side securing projection goes beyond the fitting hood portion side securing projection and is thereby engaged with the fitting hood portion side securing projection. In this operation, since part of the fitting hood portion side securing projection is formed in the reduced thickness plate portion, when the lock arm side securing projection goes beyond the fitting hood portion side securing projection, the lock arm side securing projection flexes once and thereafter returns to its original shape: that is, when the lock arm side securing projection returns to its original shape, it becomes easy to resound, which makes loud the operation sound generated when the male connector is fitted into the fitting hood portion of the female connector portion, so that the sense of moderation of the present connector of a lever type can be enhanced.

Also, according to the present invention, the reduced thickness plate portion is formed as a cantilever which is provided on and projected from the bottom wall of a recessed portion formed in the opening edge portion of the fitting hood portion.

In the present connector of a lever type, when the lock arm side securing projection is moved beyond the fitting hood portion side securing portion due to the rotation of the lever, the cantilever-shaped reduced thickness plate portion is flexed and thereafter is returned back to its original shape to thereby resound. As a result of this, the operation sound can be made louder and thus the sense of moderation of the present connector can be enhanced. Also, because the reduced thickness portion is formed in a cantilever manner, it is easy to flex greatly and resound, with the result that the operation sound can be made louder accordingly when it returns back to its original shape.

Further, according to the present invention, the fitting hood portion side securing projection is composed of an introducing inclined surface descending inclinedly from the upper end side of the fitting hood portion toward the deep portion of the fitting hood portion and an engaging inclined surface ascending inclinedly from the lower end side of the fitting hood portion toward the inner wall of the fitting hood portion, whereas the lock arm side securing projection includes an engaging inclined surface which is so formed as to ascend inclinedly from the arm portion toward the outside thereof and also which can be engaged with the engaging inclined surface of the fitting hood portion side securing projection.

In the present lever fitting type connector, if the lever is rotated, then the lock arm side securing projection is contacted with the introducing inclined surface of the fitting hood portion side securing projection; and, if the lever is rotated further, then the lock arm side securing projection is slid on the introducing inclined surface of the fitting hood portion side securing projection. And, if the lock arm side securing projection goes beyond the fitting hood portion side securing projection, then the engaging inclined surface of the lock arm side securing projection and the engaging inclined surface of the fitting-hood portion side securing projection are contacted and engaged with each other. In this operation, these two engaging inclined surfaces are contacted with each other in a surface contact manner.

Also, at least part of the fitting hood portion side securing projection is formed in the reduced thickness plate portion. Therefore, when the lock arm side securing projection goes beyond the fitting hood portion side securing projection, the reduced thickness plate portion is greatly flexed once and is thereafter returned back to its original shape: that is, the reduced thickness plate portion resounds when it returns back to its original shape. This makes it possible to make the operation sound louder and thus increase the sense of moderation of the present connector.

DETAILED DESCRIPTION OF PREFERRED EMBODIMENTS

Figure 1:
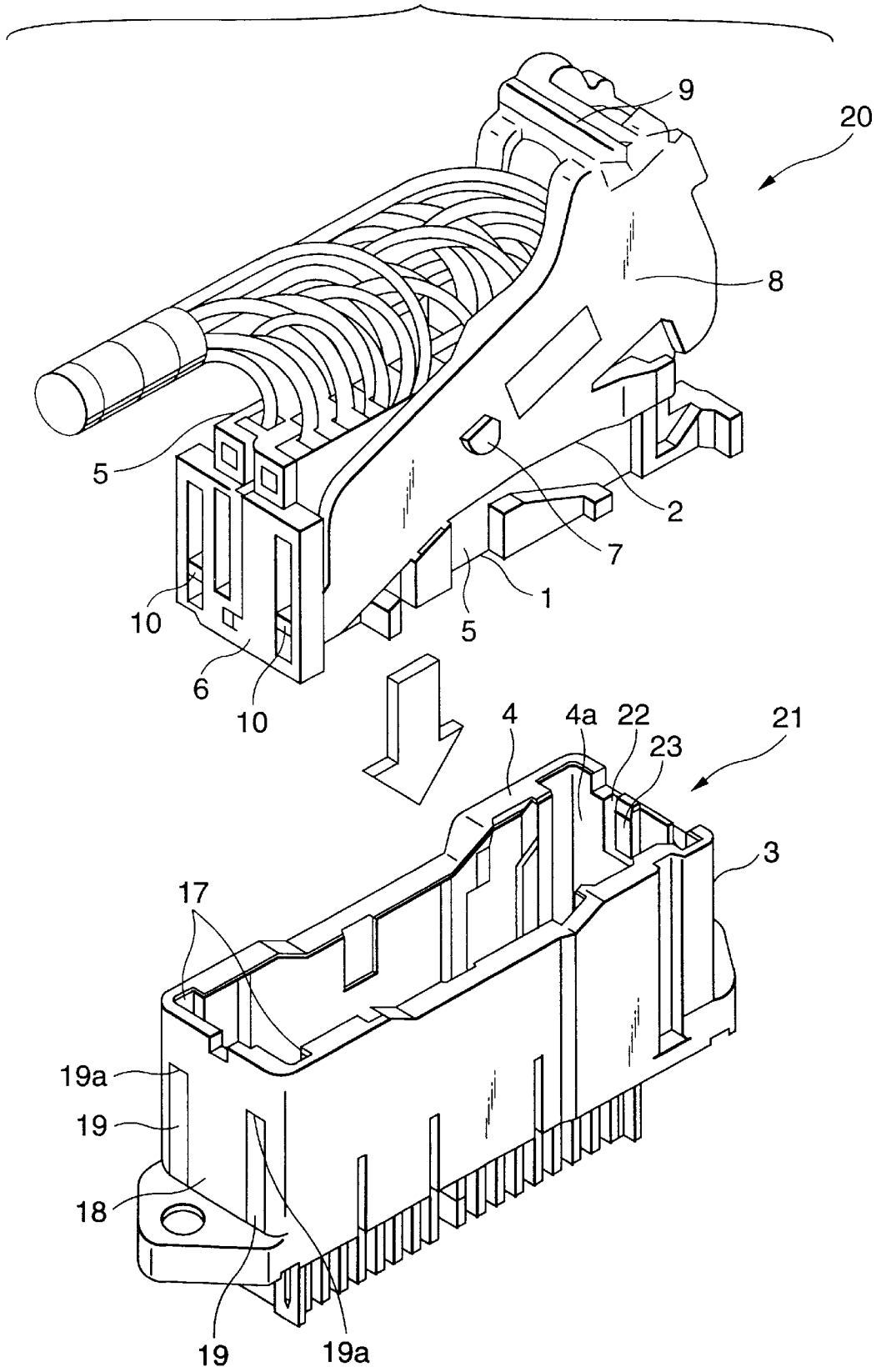
FIG. 1 is a perspective view of a lever fitting type connector according to an embodiment of the invention.
Figure 2:
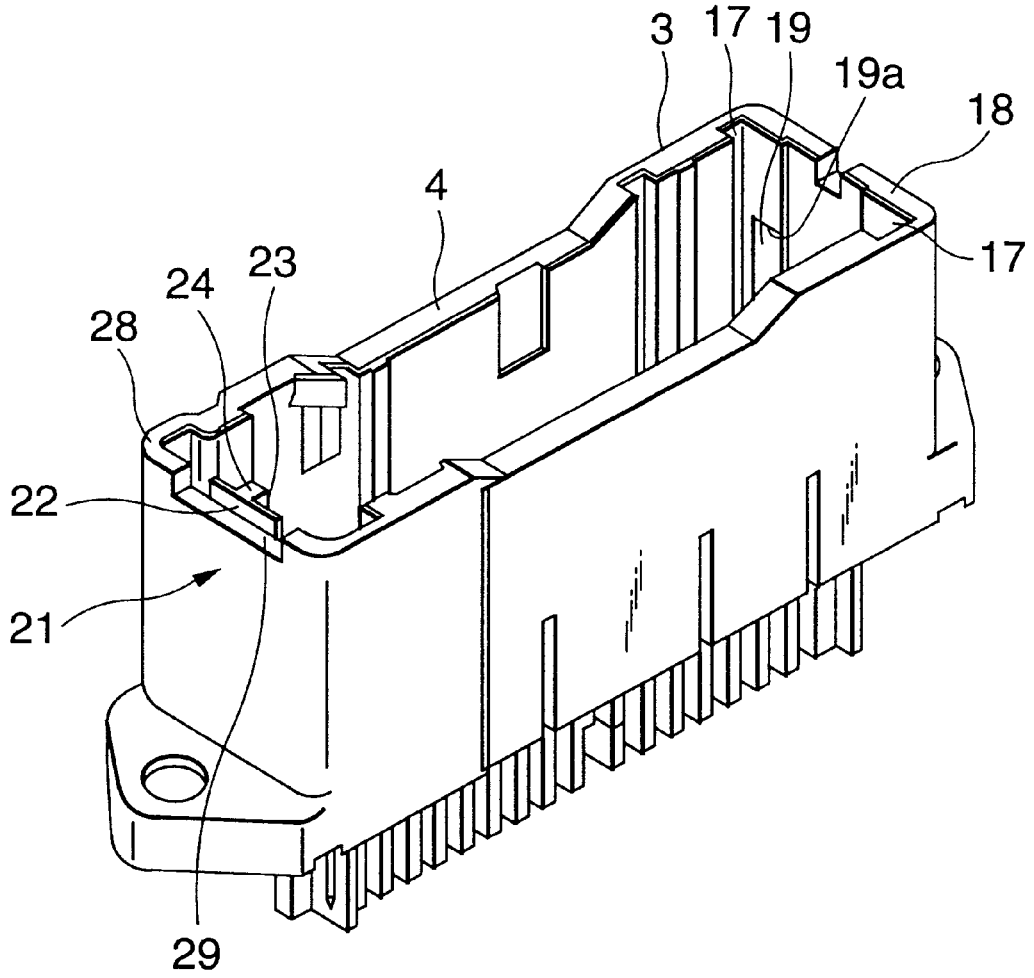
FIG. 2 is a perspective view of a female connector portion included in the lever fitting type connector according to the embodiment of the invention.
Figure 4:
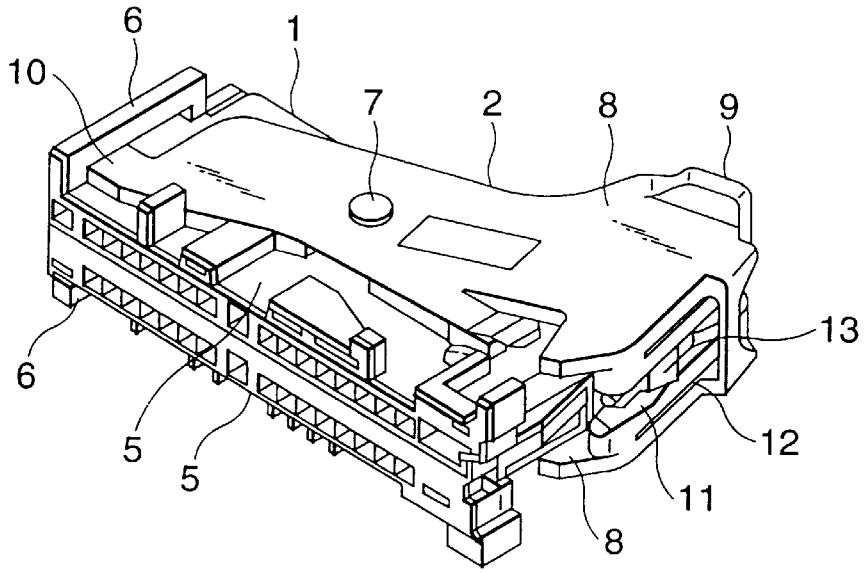
FIG.4 PRIOR ART
FIG. 4 is a perspective view of a male connector and a lever assembled to the male connector, which are respectively employed in a conventional lever fitting type connector.
Figure 5:
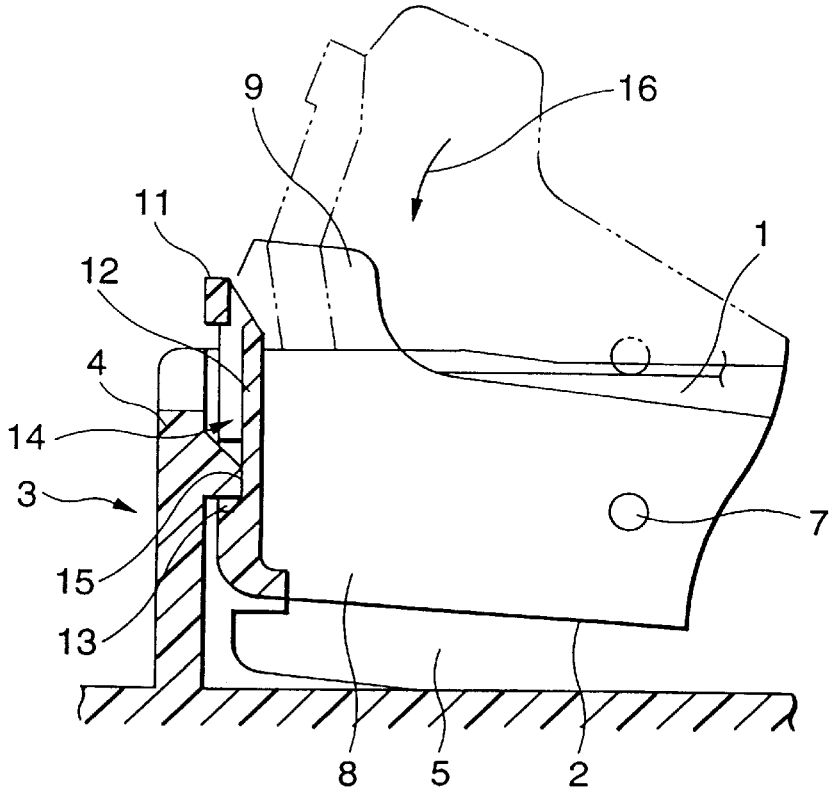
FIG.5 PRIOR ART
FIG. 5 is a section view of the conventional lever fitting type connector, showing a state thereof in which a lock arm is engaged with a lock portion; and, FIG. 6 is an enlarged section view of a portion of FIG. 5, showing the engaged state between a lock-arm-side securing position and a lock-portion-side securing projection.
Figure 6:
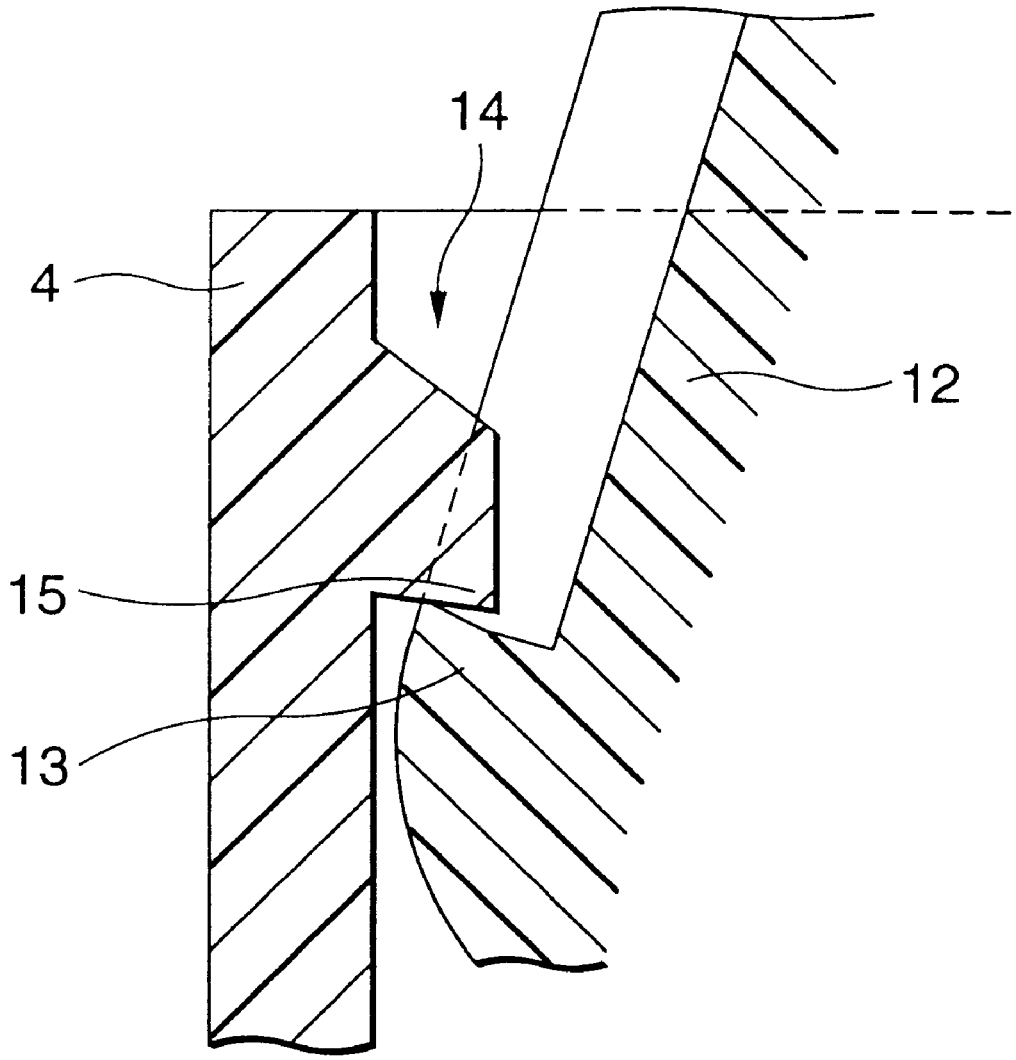
FIG.6 PRIOR ART

Now, description will be given below of an embodiment of a lever fitting type connector according to the invention with reference to the accompanying drawings. By the way, a lever fitting type connector 20 according to the present embodiment is basically similar in structure to the conventional lever fitting type connector previously shown in FIGS. 4 and 5. Therefore, the parts of the present connector are given the same designations as shown in FIGS. 4 and 5 relating to the conventional connector and thus the duplicate description thereof is omitted here. In particular, FIG. 1 is a perspective view of the present lever fitting type connector 20, and FIG. 2 is a perspective view of a fitting hood portion 4 which is formed in a female connector portion 3 of the present connector 20. Further, FIG. 3 is a section view of the connector 20, showing the engagement state between a lock arm 11 disposed on the lever 2 side and a lock portion 21 formed on the fitting hood portion 4 side.

Figure 3:
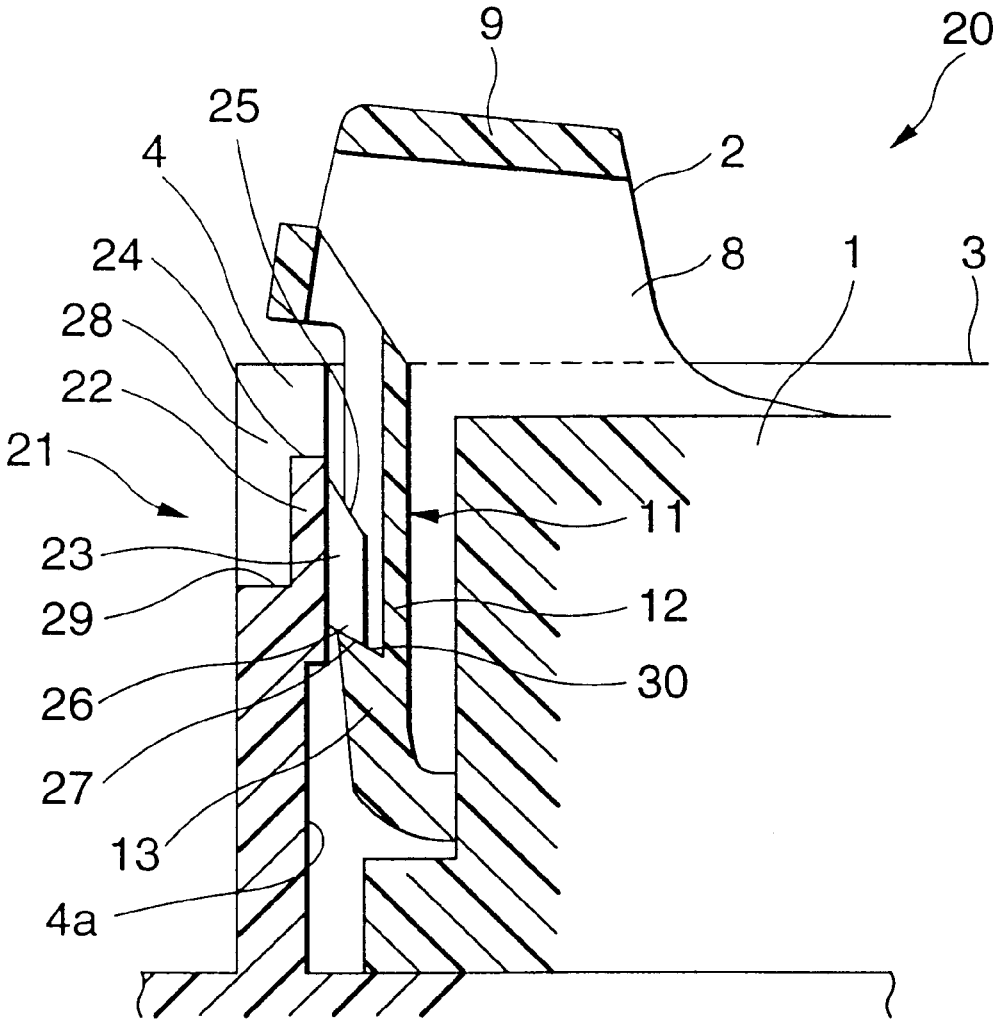
FIG. 3 is a section view of the lever fitting type connector according to the embodiment of the invention, showing a state thereof in which a male connector is fitted into a fitting hood portion of the female connector portion and a lock arm is engaged with a lock portion.

The lever fitting type connector 20 according to the present embodiment, as shown in FIGS. 1 and 3, comprises a male connector 1, a lever 2, and a female connector portion 3 including a fitting hood portion 4. Also, in the lever fitting type connector 20 according to the present embodiment, if the lock arm 11 disposed on the lever 2 is engaged with the lock portion 21 formed in the fitting hood portion 4, then the male connector 1 can be completely fitted into the fitting hood portion 4 of the male connector portion 3.

And, in the present embodiment as well, the lock arm 11 includes a flexible arm portion 12, and a lock arm 11 side securing projection 13 which is provided on the arm portion 12. Also, the lock portion 21 includes a reduced thickness plate portion 22 formed in the inner wall 4*a* of the fitting hood portion 4, and a fitting hood portion 4 side securing projection 23 at least part of which is projected from the reduced thickness plate portion 22 and also which can be engaged with the lock arm 11 side securing projection 13.

Also, the fitting hood portion 4 side securing projection 23 includes an introducing inclined surface 25 which descends inclinedly from the upper end 24 side of the securing projection 23 toward the deep side of the fitting hood portion 4, and an engaging inclined surface 27 which ascends inclinedly from the lower end 26 side of the securing projection 23 toward the inner wall 4*a* of the fitting hood portion 4. Further, the lock arm 11 side securing projection 13 includes an engaging inclined surface 30 which is so formed as to ascend inclinedly and outwardly from the arm portion 12. The engaging inclined surface 30 can be engaged with the engaging inclined surface 27 of the fitting hood portion 4 side securing projection 23.

The above-mentioned reduced thickness plate portion 22 is projected from a bottom wall 29 of a recessed portion 28 formed in the opening edge portion of the fitting hood portion 4, and the reduced thickness plate portion 22 is also disposed on the bottom wall 29 in a cantilever manner. Referring further to the structure of the reduced thickness plate portion 22, a substantially upper half of the securing projection 23 is provided on and projected from the inside of the reduced thickness plate portion 22, whereas the lower half of the securing projection 23 is provided on and projected from the inner wall 4*a* of the fitting hood portion 4.

By the way, in one side portion of the fitting hood portion 4, there are formed two elongated grooves 17 and 17 into which the play preventive rib 6 of the male connector 1 can be inserted; and, in one-side wall portion 18 of the fitting hood portion 4, there are formed two elongated holes 19 and 19 into which the projection portions 10 of the lever 2 can be respectively engaged.

Next, description will be given below of a procedure for fitting the male connector 1 into the fitting hood portion 4 of the female connector portion 3.

At first, the two boss portions 7 of the male connector 1 are respectively inserted into the right and left side walls 8 of the lever 2, and the two projection portions 10 of the lock arm 11 are respectively inserted through the play preventive rib 6 of the male connector 1, thereby assembling the lever 2 to the male connector 1 in such a manner that it can be freely rotated. And, the male connector 1 in this state is matched in position to the fitting hood portion 4 and, after then, the male connector 1 is inserted into the fitting hood portion 4, so that the play preventive rib 6 is inserted into the two long grooves 17 and 17.

In this operation, the lever 2 is kept inclined with respect to the male connector 1 so that the projection portions 10 can be situated respectively on the lower end side of the elongated holes 19.

After the male connector 1 is inserted up to the middle portion of the fitting hood portion 4, the operation portion 9 is pressed to thereby rotate the lever 2 about the boss portions 7. If the lever 2 is rotated, then the projection portions 10 are projected from the play preventive rib 6 and are then contacted with the upper inner walls 19*a* of the elongated holes 19. Further, if the operation portion 9 is rotated, then the male connector 1 can be inserted into the deep side of the fitting hood portion 4 due to the leverage: in particular, the contact portions between the projection portions 10 and upper inner walls 19*a* serve as the fulcrum, the operation portion 9 serves as the point of force and the boss portions 7 serve as the point of action.

And, if the lock arm 11 side securing projection 13 is engaged with the fitting hood portion 4 side securing projection 23, then the male connector 1 can be inserted completely into the fitting hood portion 4 of the female connector portion 3; and, the lock arm 11 is engaged with the lock portion 21, thereby being able to hold the fitted state between the male connector 1 and the fitting hood portion 4 of the female connector portion 3.

When the lock arm 11 side securing projection 13 is going to be engaged with the lock portion 21 side securing projection 23, if the lever 2 is rotated about the boss portions 7, then the lock arm 11 side securing projection 13 is firstly contacted with the introducing inclined surface 25 of the lock portion 21 side securing projection 23; and, if the lever 2 is rotated further, then the securing projection 13 is slided on the introducing inclined surface 25. At this time, if the arm portion 12 is flexed, the reduced thickness plate portion 22 is also flexed outwardly, and the lock arm 11 side securing projection 13 is moved beyond the lock portion 21 side securing projection 23, then the arm portion 12 and reduced thickness plate portion 22 are caused to return to their respective original shapes. In this operation, at the same time when the flexed state of the arm portion 12 is returned to its original state, the flexed state of the reduced thickness plate portion 22 is returned to its original state, thereby causing the reduced thickness plate portion 22 to resound, so that an operation sound when they are locked can be made louder to thereby enhance the sense of moderation.

If the lock arm 11 side securing projection 13 goes beyond the lock portion 21 side securing projection 23, then the engaging inclined surfaces 27 and 30 are contacted and engaged with each other.

According to the present embodiment, since the reduced thickness plate portion 22 is formed in the fitting-hood portion 4 side lock portion 14 and part of the securing projection 23 is formed in the reduced thickness plate portion 22, there can be generated a louder operation sound when the lock arm 11 side securing projection 13 goes beyond the lock portion 21 side securing projection 23, thereby being able to enhance the sense of moderation.

As a result of this, the lever 2 can be positively rotated up to the final position, which makes it possible not only to fit the male connector 1 completely into the fitting hood portion 4 of the female connector portion 3 but also to eliminate the possibility of the incompletely locked state of the lever, thereby being able to hold positively the fitting state of the male connector 1 into the fitting hood portion 4. Further, because the incompletely locked state can be eliminated, the lever 2 can be surely prevented against unexpected rotation.

As has been described heretofore, according to the present invention, since part of the fitting hood portion side securing portion is formed in the reduced thickness plate portion, when the lock arm side securing projection goes beyond the fitting hood portion side securing portion, the lock arm side securing projection is greatly flexed and thereafter is returned back to its original shape to thereby resound, so that the operation sound generated when the male connector is locked into the fitting hood portion of the female connector portion can be made louder and thus the sense of moderation of the present connector can be enhanced.

Also, according to the present invention, when the lock arm side securing projection is moved beyond the fitting hood portion side securing portion due to the rotation of the lever, the cantilever-shaped reduced thickness plate portion is flexed and thereafter is returned back to its original shape to thereby resound, so that the operation sound generated when the male connector is locked into the fitting hood portion of the female connector portion can be made louder and thus the sense of moderation of the present connector can be enhanced. Also, because the reduced thickness portion is formed in a cantilever manner, it is easy to flex greatly, with the result that the operation sound can be made louder accordingly when it returns back to its original shape.

Further, according to the present invention, if the lock arm side securing projection is moved beyond the fitting hood portion side securing portion, then the engaging inclined surface of the lock arm side securing projection and the engaging inclined surface of the fitting hood portion side securing portion are contacted and engaged with each other. In this engaging operation, these engaging inclined surfaces are contacted with each other in a surface contact manner. Also, at least part of the fitting hood portion side securing portion is formed in the reduced thickness plate portion. Therefore, when the lock arm side securing projection goes beyond the fitting hood portion side securing portion, the reduced thickness plate portion is greatly flexed once and is thereafter returned back to its original shape. This makes it possible to make the operation sound louder and thus increase the sense of moderation of the present connector.

What is claimed is:

1. A lever fitting type connector comprising:

a male connector;

a lever to be rotatably assembled to said male connector;

a female connector including a fitting hood portion into which, by rotating said lever, said male connector can be inserted and fitted; and a lock arm, provided on said lever, engaged with a lock portion formed in said fitting hood portion so that said male connector can be completely fitted into said fitting hood portion of said female connector, said lock arm including a flexible arm portion and a lock arm side securing projection provided on said flexible arm portion, said lock portion defined by a reduced thickness plate portion formed in an inner wall of said fitting hood portion and a fitting hood portion side securing projection projecting from said reduced thickness plate portion and with said lock arm side securing projections, wherein a thickness of said reduced thickness plate portion is less than a thickness of said inner wall of said fitting hood portion such that said reduced thickness plate portion deflects during the engagement of said fitting hood side securing projection with said lock arm side securing projection.

2. A lever fitting type connector as claimed in claim 1, wherein said reduced thickness plate portion is formed in such a manner that a cantilever is provided on and projected from the bottom wall of a recessed portion formed in the opening edge portion of said fitting hood portion.

3. A lever fitting type connector as claimed in claim 1, wherein said fitting hood portion side securing projection is defined by an introducing inclined surface descending inclinedly from the upper end side of said fitting hood portion toward the inner portion of said fitting hood portion and an engaging inclined surface ascending inclinedly from the lower end side of said fitting hood portion toward the inner wall of said fitting hood portion, and wherein said lock arm side securing projection includes an engaging inclined surface which is so formed as to ascend inclinedly from said arm portion toward the outside thereof and also which can be engaged with said engaging inclined surface of said fitting hood portion side securing projection.

4. A lever fitting type connector as claimed in claim 2, wherein said fitting hood portion side securing projection is defined by an introducing inclined surface descending inclinedly from the upper end side of said fitting hood portion toward the inner portion of said fitting hood portion and an engaging inclined surface ascending inclinedly from the lower end side of said fitting hood portion toward the inner wall of said fitting hood portion, and wherein said lock arm side securing projection includes an engaging inclined surface which is so formed as to ascend inclinedly from said arm portion toward the outside thereof and also which can be engaged with said engaging inclined surface of said fitting hood portion side securing projection.

* * * * *